US007404405B1

(12) United States Patent
Mehio

(10) Patent No.: US 7,404,405 B1
(45) Date of Patent: Jul. 29, 2008

(54) PORTABLE HOOKAH SYSTEM AND HOOKAH CONTAINMENT DEVICE

(75) Inventor: Nizar Youssef Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 0 days.

(21) Appl. No.: 11/968,703

(22) Filed: Jan. 3, 2008

(51) Int. Cl.
*A24F 1/14* (2006.01)
*A24F 1/30* (2006.01)

(52) U.S. Cl. ..... 131/173; 131/191; 131/330; 131/348; 362/180; 312/235.8

(58) Field of Classification Search ..... None
See application file for complete search history.

(56) References Cited

U.S. PATENT DOCUMENTS 1,553,538 A * 9/1925 Kelly ..... 362/180
3,061,370 A * 10/1962 Murphy ..... 312/235.8
4,164,950 A 8/1979 Bechtold
4,187,885 A * 2/1980 Kahler ..... 138/89
5,489,043 A 2/1996 Newman
2006/0107964 A1 5/2006 Harout

* cited by examiner

*Primary Examiner*—Philip C Tucker
*Assistant Examiner*—Phu H Nguyen
(74) *Attorney, Agent, or Firm*—General Counsel, P.C.; M. Keith Blankenship

(57) ABSTRACT

Disclosed is a hookah containment device that allows a user to smoke a prepared hookah while engaging in foot traffic. A portable hookah system includes a hookah and the hookah containment device tailored to mate with the hookah in a fashion to vertically stabilize the hookah during turbulent locomotion. The hookah containment device includes a sidewall adapted to form an interference fit with a hookah base, or includes within a receiving chamber means for releasably attaching the hookah within the interior of the hookah containment device.

10 Claims, 7 Drawing Sheets

PORTABLE HOOKAH SYSTEM AND HOOKAH CONTAINMENT DEVICE

FIELD OF THE INVENTION

The present invention relates to the field of smoking implements and more specifically to the field of hookah accessories.

BACKGROUND

Of the many proud traditions of Ottoman culture, few have achieved the world-wide fame of hookah smoking. Once confined to the Middle East and Near East regions, the hookah's notoriety was invigorated by Napoleon's invasion of Egypt and the stream of curious Westerners which followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a base, a stem, at least one hose with a mouthpiece, and a bowl. The hookah bowl holds the hookah tobacco, frequently "massell." Massell is a mixture of tobacco, molasses, and often a flavor or fruit extract. The molasses and fruit extract add a substantial amount of moisture to the massell that is missing in conventional tobacco. This added moisture makes massell more sensitive to the elements relative to conventional tobacco; prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah bowl to allow heat to evenly circulate through the pile.

The heat that ignites the massell derives from coals positioned above the hookah bowl. The coals and massell preferably never contact one to the other. A common method of placing coals proximate to the massell involves spreading a foil upon the top of a hookah bowl, punching holes in the foil, and then placing the coals onto the foil. The heat from the lighted coals travels through the holes in the foil to ignite portions of the massell. Particulates from the massell travel in the smoke created by the ignition down through the hookah bowl into the hookah pipe.

The hookah stem is the body of a hookah and is usually fabricated from brass, tin, or stainless steel. The stem transports the massell smoke from the bowl to the hookah base, which is a cavern containing water. The base of the hookah is typically fabricated of glass or plastic and tends to be the most expressive portion of the hookah, ranging from translucent to wildly-colored. Within the cavern of the hookah base, the massell smoke is cooled by the water within. The cooled massell smoke then returns to the stem, though not through the same entrance by which the massell smoke enters the base. From the stem, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the stem and the hookah bowl. The Egyptian style hookah pipe tapers upward into what is generally referred to as a male connection. The Egyptian style hookah bowl includes a female connection which receives the pipe's male connection. In the Lebanese style hookah the bowl has the tapered male connection and the pipe has the female connection to accept the Lebanese style hookah bowl. In both styles, to allow a more airtight connection a collar is generally added to fit around the male connection.

As hookah use increases in prominence, the need to make hookah smoking more amenable to a larger market increases in importance. One of the primary differences between hookahs and other conventional forms of tobacco products involves portability. The user of a cigar, cigarette, or pipe can travel relatively unhindered while using his choice of tobacco product. A hookah, however, is not generally considered to be a portable instrument. It weighs considerably more than conventional tobacco products and instruments, has a high profile that contributes to an awkward mechanical balance, is often fabricated of delicate materials, and is often loosely assembled by fit. Therefore there is a need for innovation that allows a hookah to be transported in useable position that adequately protects the hookah while simultaneously providing to a user to the ability to smoke massell from the hookah.

SUMMARY

The present invention comprises a portable hookah containment device, and a system comprising the portable hookah containment device and a hookah. The present invention allows a prepared hookah to be transported during use. An embodiment of the hookah containment device includes an aerated hookah receiving chamber. The aerated hookah receiving chamber has a base which is structured to support the hookah, and also includes a sidewall with at least one hose outlet. At the apex of the sidewall is an opening that allows a hookah to be positioned within the receiving chamber.

Connected to the hookah receiving chamber is a handle. The handle is allows a user to tote the device and any hookah placed within along a substantially planar path of travel.

The portable hookah system of the present invention includes an embodiment of the hookah containment device and a hookah. The hookah of the system includes at least a hookah base, a hookah stem, and a hookah hose. There is a connection between the hookah stem and hookah base that is releasable and self-supporting. The hookah containment device of the system includes a receiving chamber with a chamber base and chamber sidewall. The chamber base is adapted to accept and vertically stabilize the hookah. The sidewall has a height adapted to enclose a portion of the hookah. In one embodiment of the portable hookah system, the height of the sidewall is adapted to enclose the hookah base. In another embodiment of the hookah system, the height of the sidewall is adapted to enclose the hookah stem and the chamber includes an aperture for the hookah hose. In still another embodiment of the hookah system, the height of the sidewall is adapted to enclose the entire hookah.

The system of the present invention includes a hookah that is designed to mate with the hookah receiving chamber; i.e. each component is structured to be used with the other. The chamber is adapted to stabilize the hookah of the system through mating attachments or size. In embodiments of the system where size is utilized to stabilize the hookah, the hookah base includes a size that is approximately equal to the size of the hookah receiving chamber. In embodiments of the system where mating attachments are utilized to stabilize the hookah within the receiving chamber, both the base and the receiving chamber include one or more attachments such as snaps, protrusions, hook-and-loop fasteners, and the like. The system of the present invention allows a user to prepare a hookah for smoking, and yet be mobile.

Therefore, it is an aspect of the present invention to accommodate a hookah user in transporting a prepared hookah.

It is a further aspect of the present invention to allow a hookah user to draw smoke from his hookah during periods of user mobility.

It is a further aspect of the present invention to give hookahs in use a degree of the portability inherent in cigars, cigarettes, and pipes.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
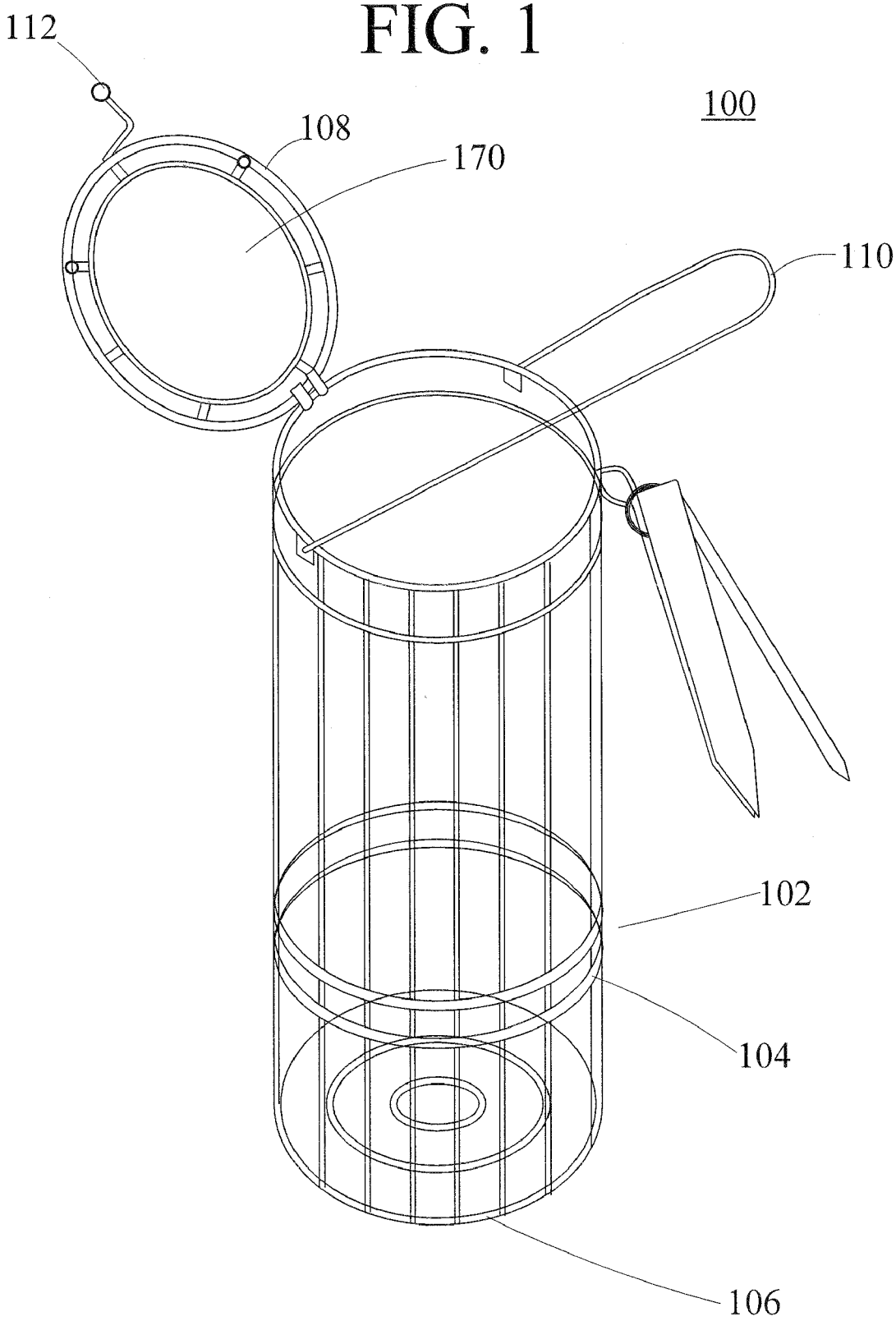
FIG. 1 is a perspective view of an embodiment of the hookah containment device of the present invention.

Referring first to FIG. 1, an embodiment of the hookah containment device 100 is shown. The device 100 allows a prepared hookah to be transported by a human in a mobile fashion. A prepared hookah is a hookah set up to be smoked; which may include the presence of an internal liquid, coals within a bowl, or other preparations common to hookah smoking. Although capable of transporting a prepared hookah in use, the present invention may further be used simply to transport a hookah in a convenient manner.

The hookah containment device 100 includes an aerated receiving chamber 102 composed of a chamber sidewall 104, a chamber base 106, and chamber topwall 108. The sidewall 104 is shaped circularly as a hollow cylinder, as most hookahs include a circular shape. Materials capable of use in the sidewall include sturdy materials capable of resistance to environmental effects. As a hookah will be placed into the receiving chamber in very close proximity to the sidewall 104, the sidewall 104 is preferably constructed of a metal, but other sturdy materials will similarly suffice, e.g. wood, strong cardboard, plastic, etc. The chamber sidewall 104 includes large gaps throughout its body to promote air circulation and allow any hookah within to be visible. The preferred means for accomplishing the necessary sturdiness while achieving the benefits of a high degree of air circulation is the presence of multiple vertical steel bars with multiple supporting horizontal bars.

The chamber base 106 of the hookah containment device 100 is a substantially flat surface configured to allow a hookah base to rest thereon. The chamber base 106 includes an aerated configuration that allows air circulation throughout the receiving chamber 102. It is preferred that the chamber base is preferably constructed of a material similar to that of the sidewall 104; any sturdy material will suffice, e.g. metal, wood, strong cardboard, plastic, etc. The chamber base 106 includes a surface that is dimensioned to accept a hookah with little remaining chamber base surface remaining between itself and the sidewall 104. Thus the receiving chamber 102 will often be structured with one or more specific hookahs as guides for the dimensions of the chamber base 106 and sidewall 104; although in other instances, a standard dimensioning for the chamber base 106 and sidewall 104 will be appropriate.

The topwall 108, or cover, of the receiving chamber 102 is at the apex of the sidewall 104. When used with the present invention, the topwall 108 adds further stabilization to any hookah within the receiving chamber 102 by assisting to prevent vertical motion. The topwall 108 may be any shape used to prevent vertical motion of hookah within, and is preferably a releasable cover that includes merely enough material to block egress of a hookah within the receiving chamber 102 such that a stem of the hookah is allowed to pass through a stem outlet 170. The topwall 108 includes a chamber fastener 112 which attaches one portion of the receiving chamber 102 to itself, here the topwall 108 to the sidewall 104.

Attached to the receiving chamber 102 is a handle 110. The handle 110 of the present invention allows a user to grasp and transport the hookah containment device 100 in a substantially planar path of travel. By substantially planar path of travel, it is meant that, if the handle is carried at a generally level path of travel, then the receiving chamber 102 will also move at a generally level path of travel. The handle 110 shown is a curved metal bar, but other handles 110 capable of use in the present invention include resilient handles such as straps, string, cords, etc. and also non-resilient handles such as affixed horizontal bars with finger grips and the like.

Figure 2:
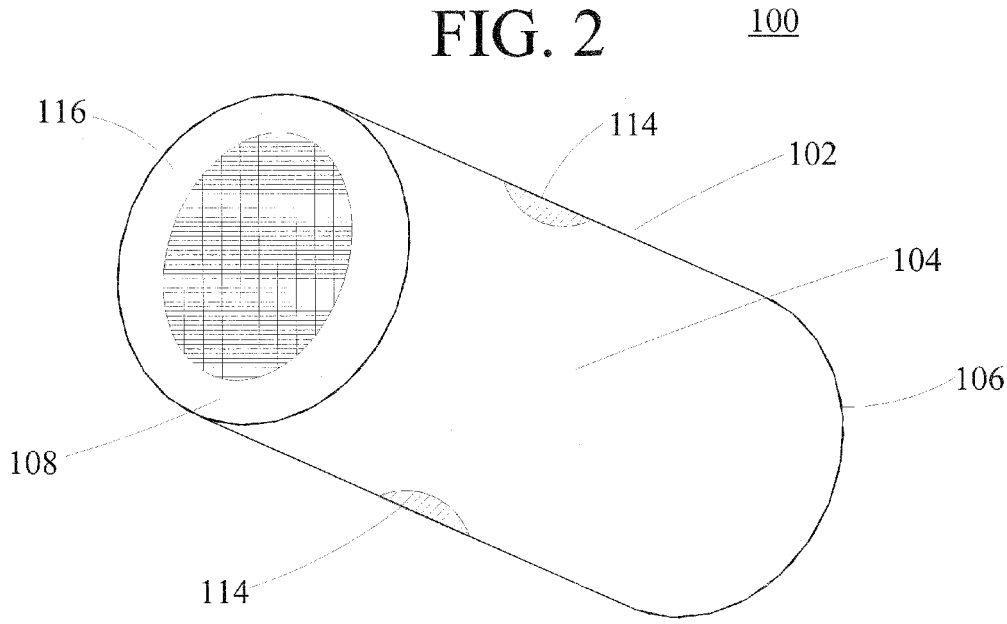
FIG. 2 is a perspective view of the receiving chamber of the hookah containment device of the present invention.
Figure 3:
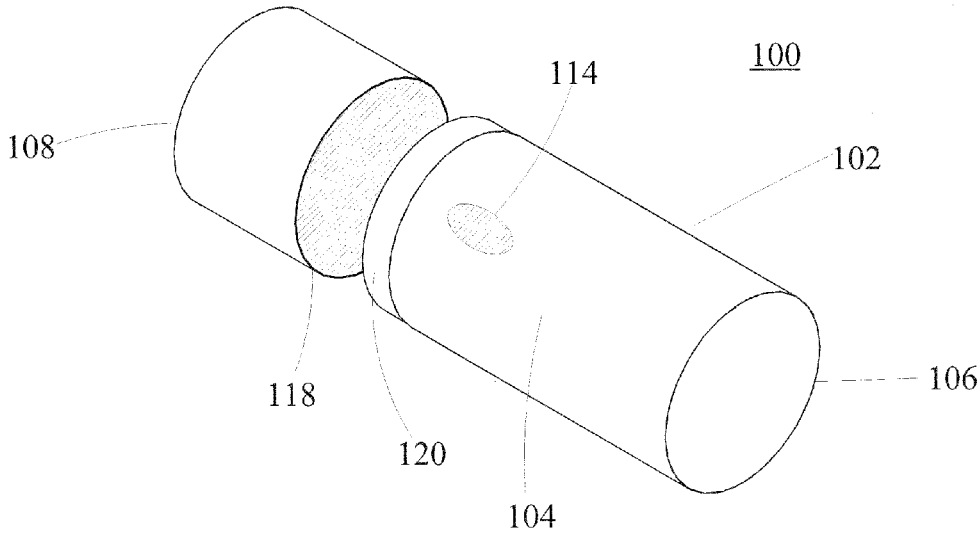
FIG. 3 is a perspective view of the receiving chamber of the hookah containment device of the present invention.

As FIGS. 2 and 3 illustrate, embodiments of the hookah containment device 100 may feature alternative receiving chamber 102 structures. The hookah containment device 100 embodiment of FIG. 2 includes a sidewall 104 that is generally closed with the exception of two hose outlet 114 apertures. The hose outlets 114 are present in embodiments of the hookah containment devices 100 that would otherwise block a user's access to a hookah hose of a hookah within. Other embodiments of the present invention may include only a single hose outlet, or multiple outlets. It is preferred that the hose outlet 114 is positioned through the sidewall 104; although alternate embodiments may position the hose outlet on the topwall 108. In embodiments of the present invention lacking a topwall 108, the hose outlet would likely be unnecessary—although still possibly advantageous.

As a hookah requires oxygen for combustion, a closed receiving chamber would not be advantageous. In embodiments of the hookah containment device 100 having one or more generally solid outer surfaces, it is preferred that there be an air inlet 116 positioned proximate to the apex of the receiving chamber—where a hookah bowl may be placed. The air inlet 116 includes one or more openings that allow the incursion of air into the receiving chamber 102. The preferred location of the air inlet 116 is the topwall 108 of the receiving chamber 102. As shown in FIG. 2, the air inlet 116 may include a screen or other member related to the passage of air.

Now turning to FIG. 3, the hookah containment device 100 has a receiving chamber 102 that forms a repository for the placement of a hookah. As an access point, the receiving chamber 102 defines a space to allow such placement. FIG. 3 illustrates an embodiment of the receiving chamber 102 adapted for interference assembly. The receiving chamber 102 is composed of two portions: one portion includes an inner lip 120, the second portion includes an outer lip 118; each lip forms an interference fit with the other. By interference fit it is meant: that two or more components are structured to fit one to the other in such a manner that static friction between the two components prevents slippage of each component with respect to the other; or that a first component is placed in such close proximity to a second component that movement of the first component will be blocked by the second component to a degree that renders such movement insubstantial. The inner lip 120 forms an interference fit with the outer lip 118 that prevents accidental slippage of each lip when the receiving chamber 104 is held erect.

Figure 4:
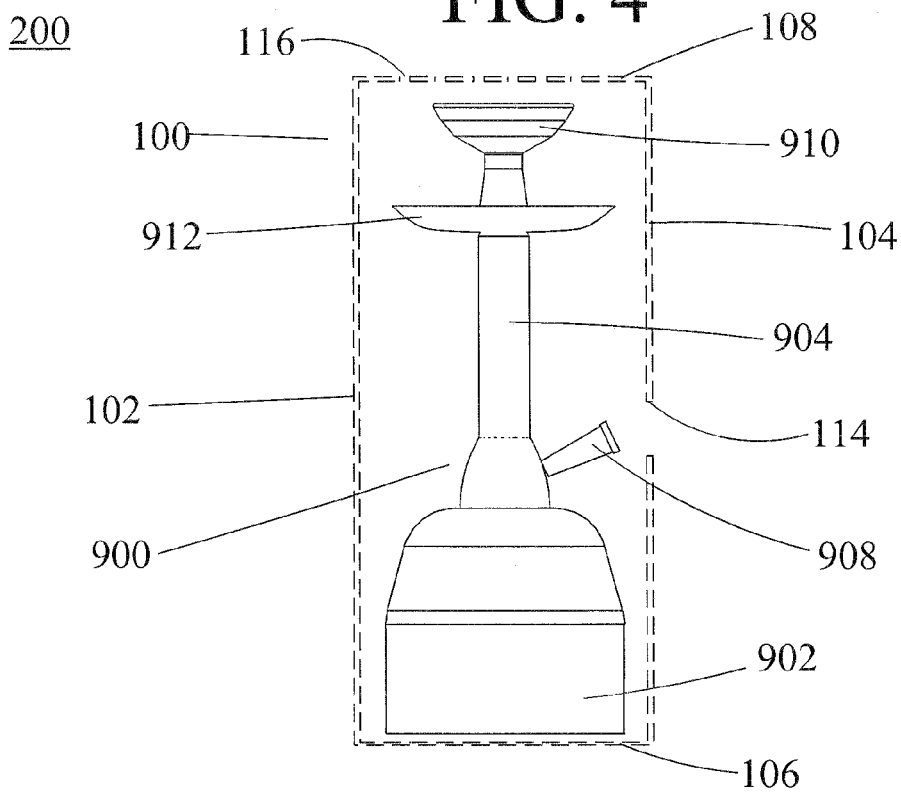
FIG. 4 is a plan view of an embodiment of the system of the present invention.

FIG. 4 illustrates an embodiment of the portable hookah system 200 of the present invention. The system 200 includes a hookah 900 and the hookah containment device 200 adapted to contain the hookah 900. The hookah 900 includes at least a hookah base 902, hookah stem 904, and hookah hose 906. The receiving chamber 104 of the system 200 is dimensioned to vertically stabilize the hookah 900 while prepared. The preferred means for vertically stabilizing the hookah 900 within the system 200 is by sizing the chamber base 106 to form an interference fit with the hookah base 902 of the system 200. The distance between the exterior edge of the hookah base 902 is proximate to the interior edge of the sidewall 104 of the receiving chamber 102 to a degree that minimizes movement of the hookah 900 within the hookah containment device 100. As a prepared hookah would contain water in its base and heated coals within its bowl, the distance between the sidewall 104 and the hookah base 902 is such that water disturbance and coal spillage are prevented in the event of hookah 900 movement.

The hookah 900 of the present invention includes self-supporting connection means between the hookah stem 904 and the hookah base 902. The self-supporting connection includes one or more connection components adapted to maintain a rigidly sealed position between the hookah stem and hookah base. It is often the case that hookahs include connection points that merely allow one component to drop on to another in manner stable only to static smoking. Slight movements are typically sufficient to disengage such drop connections. The present invention relies on more stable connection means which support the connection between the hookah base and hookah stem while the hookah is in substantially turbulent motion. Suitable connection means for the present invention includes threaded connection points, resilient stoppers adapted to form a tight fit between two components, and the like.

The embodiment of the system 200 of FIG. 4 includes a substantially closed receiving chamber 102 having a single hose outlet 114 to allow hookah hose (not shown) connection. The receiving chamber 102 includes a sidewall 104, chamber base 106, and topwall 108, which in combination, enclose the hookah 900 entirely within the receiving chamber 102. Within the sidewall 104 a single hose outlet 114 is positioned proximate to the hookah wet smoke outlet 908. As the hookah containment device 100 is tailored to the particular hookah 900 of the portable hookah system 200, such an arrangement may be accurately achieved.

Figure 5:
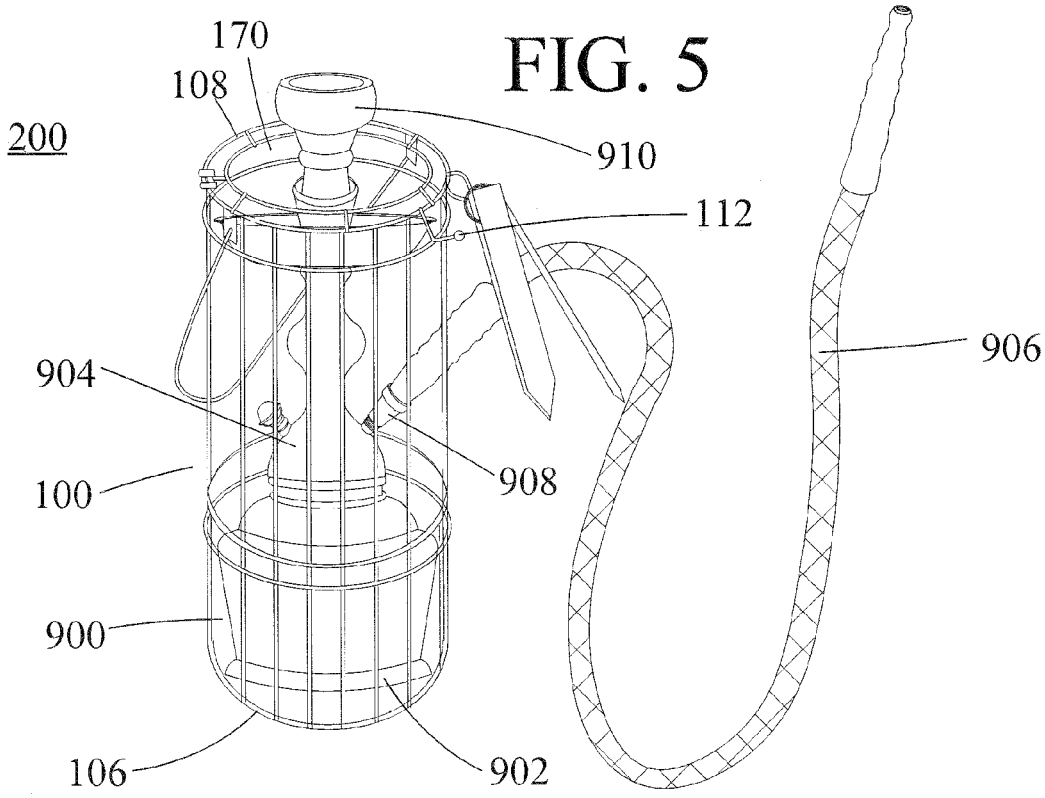
FIG. 5 is a perspective of an embodiment of the system of the present invention.

The embodiment of the portable hookah system 200 pictured in FIG. 5 includes a receiving chamber 102 having an aerated sidewall 104 and topwall 108, both of which are fabricated of multiple steel bars. The bars are spaced to a degree that allows circulation within the receiving chamber and further allows passage of a hookah hose 906 through the sidewall 104. As the sidewall 104 constructed creates multiple inherent apertures, a distinct hose outlet is unnecessary. The topwall 108 includes multiple steel bars that allow the bowl 910 of the hookah 900 to project above the hookah containment device 100. It is not necessary that the hookah containment device 100 completely enclose the hookah 200, although embodiments of the present invention may include such a feature. The topwall 108 includes a chamber fastener 112 that snaps onto the sidewall 104 to releasably affix the topwall 108 to the sidewall 106.

The system 200 may additionally include accessories relevant to the hookah preparation and use attached to the hookah containment device 100. Coal tongs 950 are included in the embodiment of FIG. 5 and releasably attached to the topwall 108.

Figure 6:
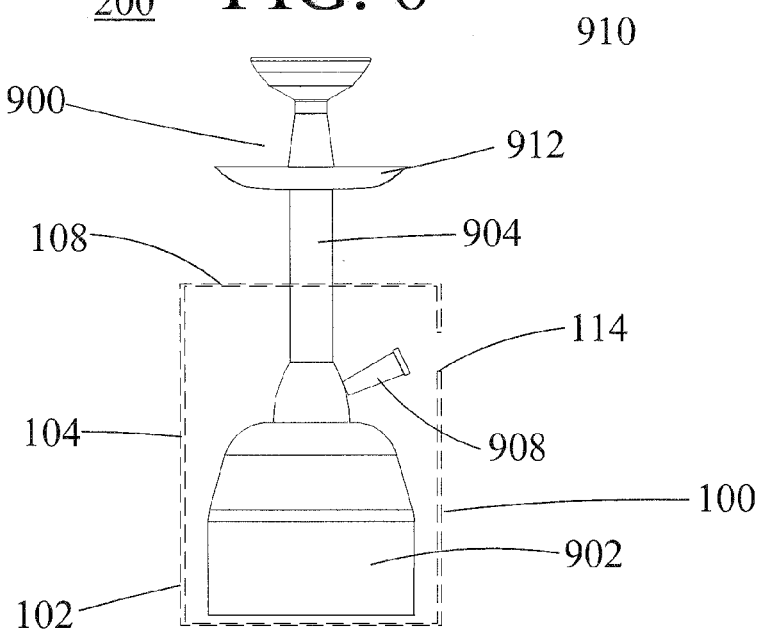
FIG. 6 is a plan view of an embodiment of the system of the present invention.

FIG. 6 depicts an embodiment of the portable hookah system 200 adapted to merely enclose a portion of the hookah 900. The sidewall 104 possesses a height that houses a portion of the hookah stem 904 and the entire hookah base 902. As the hookah wet smoke outlet 908 of the hookah 900 is covered by the receiving chamber 102, a hose outlet 114 is present in the sidewall 104 of the receiving chamber. In other embodiments of the present invention, the hose outlet 114 may be located within the topwall 108.

Figure 7:
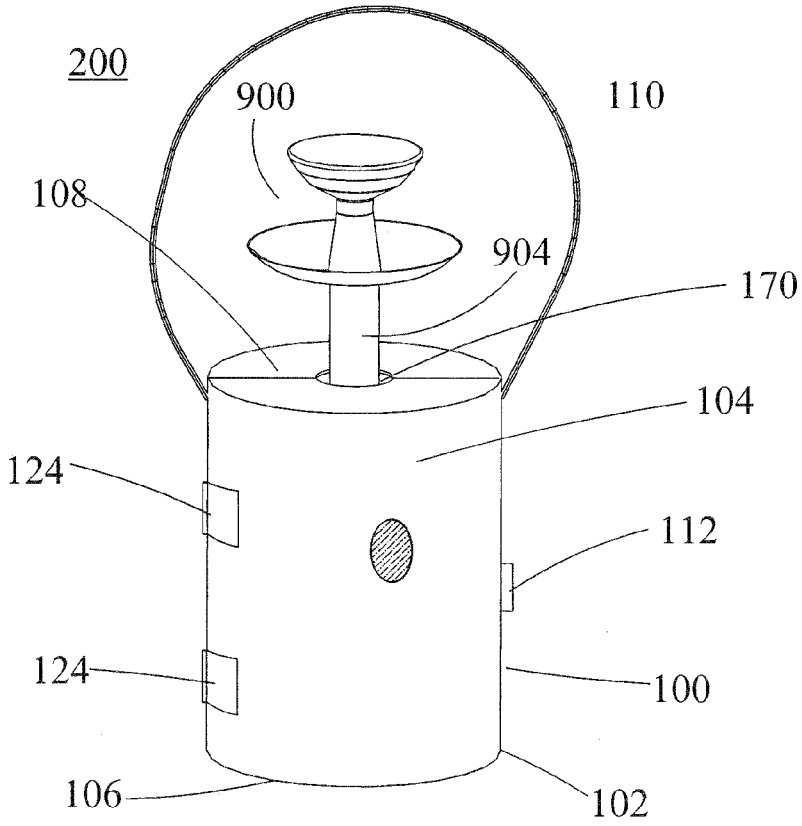
FIG. 7 is a perspective view of an embodiment of the system of the present invention.

FIG. 7 shows an embodiment of the portable hookah system 200 having an actuating sidewall 104. The sidewall 104 is vertically-bifurcated into two horizontally-situated portions; each portion joined to the other by one or more hinges 124. Opposite the hinges 124, a chamber fastener 112 joins the two portions when the hookah 900 is inserted within the receiving chamber 102. As the sidewall height is less than the combined height of the hookah stem 904 and hookah base (not shown), the top wall 108 of the receiving chamber 102 defines a stem outlet 170 that allows the hookah stem to protrude from the receiving chamber 102. The handle 110 of the hookah containment device is a cord connected at points near the apex of the sidewall 104.

Figure 8:
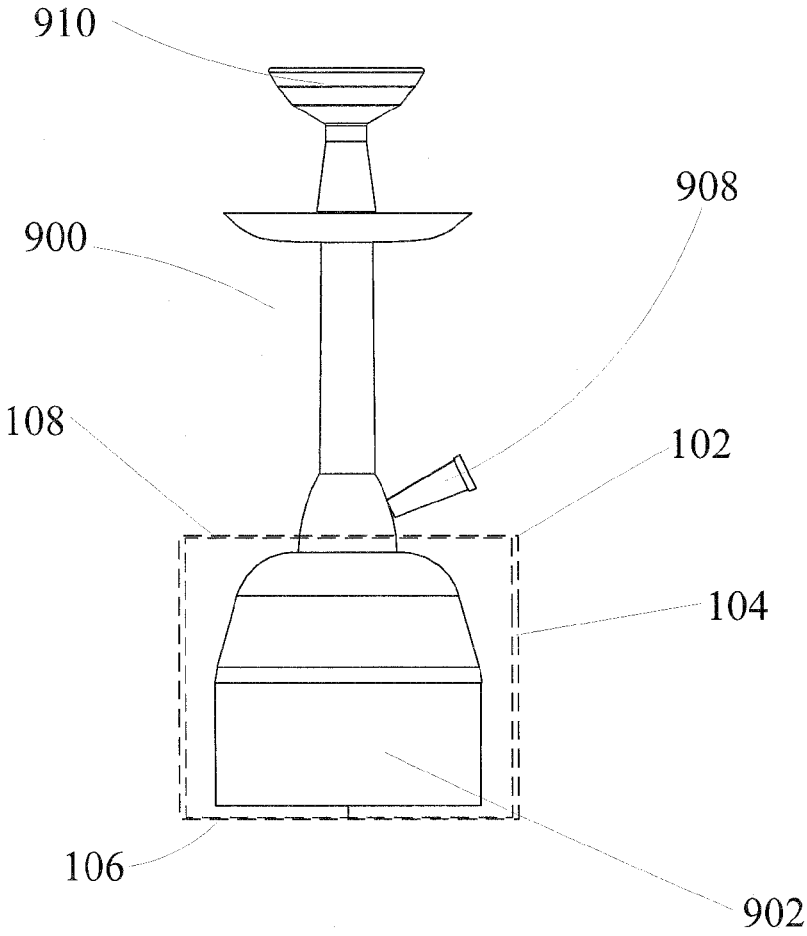
FIG. 8 is a plan view of an embodiment of the system of the present invention.

As shown in FIG. 8, embodiments of the portable hookah system 200 may include a sidewall 104 having a height sufficient to house the hookah base 902, but dimensioned not to cover the hookah wet smoke outlet 908. The handle (not shown) for such embodiments is preferably a pliant cord sized to be able to extend above the bowl 910 of the hookah. The portable hookah system 200 embodiments disclosed in FIGS.

4-8 feature an interference fit scheme for vertically stabilizing a prepared hookah during turbulent periods of movement. Alternative means for stabilizing the hookah 900 may be used with the present invention as well.

Figure 9:
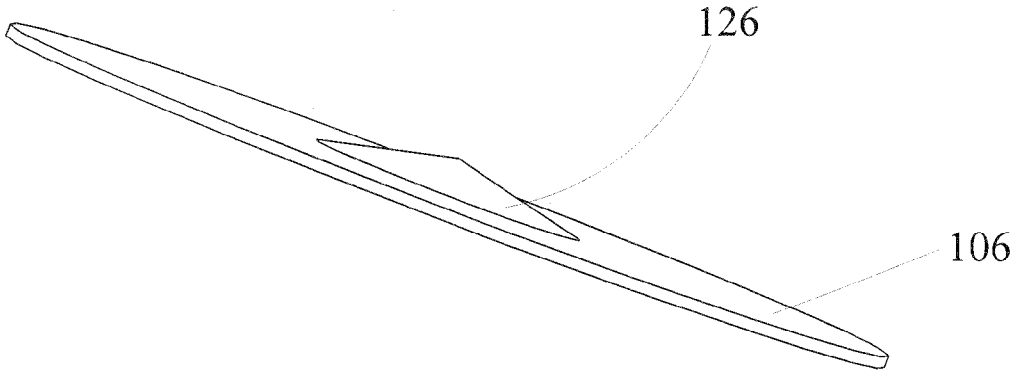
FIG. 9 is a perspective view of the chamber base of an embodiment of the system of the present invention.

FIG. 9 illustrates a preferred alternative means for vertically stabilizing a prepared hookah within the receiving chamber of the present invention. Shown is the chamber base 106 bearing a single protrusion 126 on its surface, which would be dimensioned fit within a mating groove on the base of a hookah. Other types of fastening assemblies would similarly be part of the present invention. One or more attachments such as snaps, protrusions, hook-and-loop fasteners, and the like could be situated on the hookah base and either the chamber base or chamber sidewall.

Figure 10:
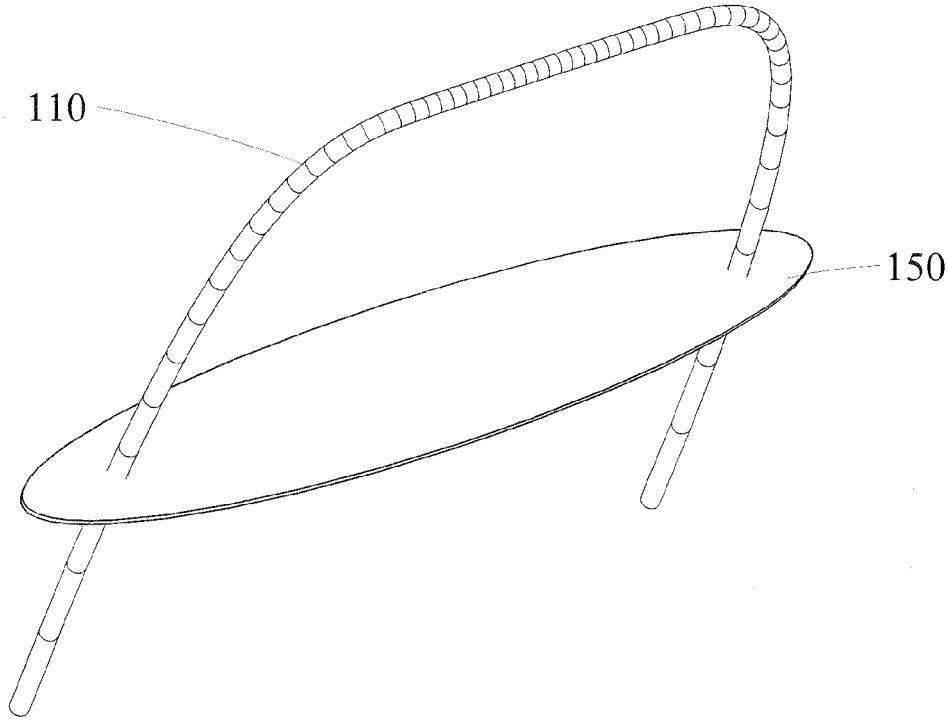
FIG. 10 is perspective view of a handle of the present invention.

FIG. 10 depicts a preferred handle arrangement of the present invention. For handles 100 fabricated of a generally rigid material, such as metals and the like, it is preferred that a handle barrier 150 be integrated thereto. The handle barrier 150 is an object attached to the handle 110 or the chamber (not shown) that possesses a surface suitable to either absorb or deflect heat from a bowl used with a hookah within the receiving chamber. The barrier 150 acts as a shield that prevents heated coals used with the present invention from contacting a user in an uncomfortable manner. The preferred dimensions of the barrier are substantially planar shapes, and the preferred material is metal—although alternate embodiments may utilize a pliable material such as cloth, or deformable plastic. It is preferred that the barrier be incorporated into the handle of the present invention; however, the barrier may stem from an upper portion of the receiving chamber.

Figure 11:
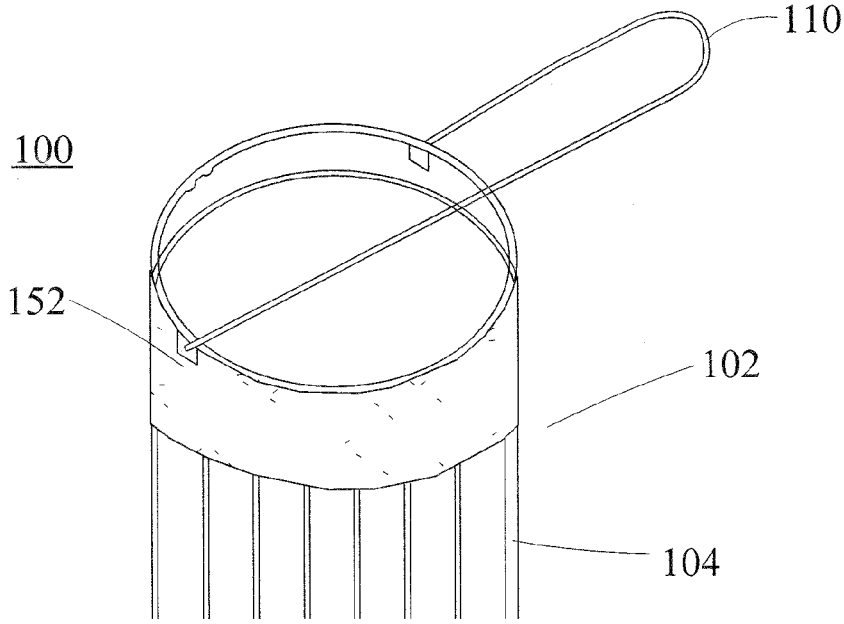
FIG. 11 is a perspective view of an upper portion of the receiving chamber of the present invention.

FIG. 11 illustrates an embodiment of a wind cover 152 of the present invention. As the present invention will likely be used with coals or other hookah related combustion materials, certain embodiments of the present invention may include means for deflecting wind. The wind cover 152 of the present invention is a component that prevents a sidelong rush of air into areas where a hookah bowl would likely be positioned. The wind cover 152 may be integrated into the receiving chamber of the present invention, or alternatively the wind cover may be a distinct component that interacts with the hookah coal tray in a manner to shield the hookah bowl from wind effects.

Figure 12:
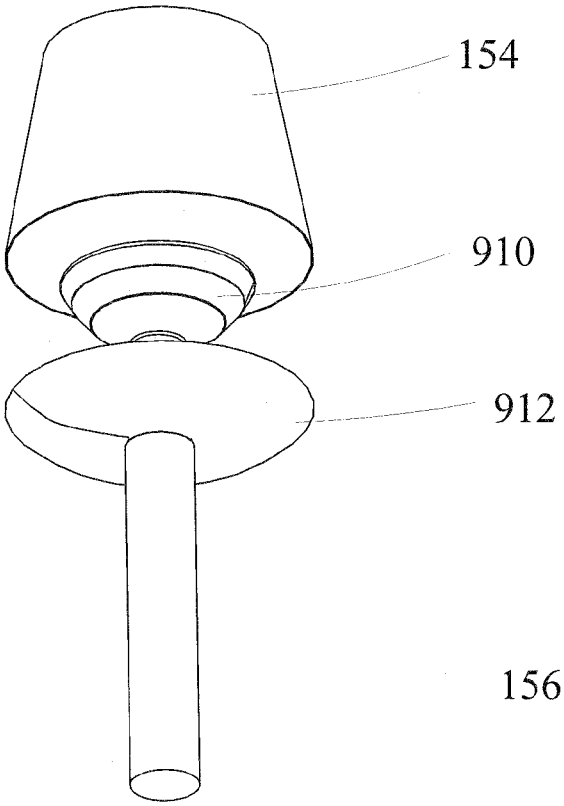
FIG. 12 is a perspective view of a portion of the hookah of the present invention.
Figure 13:
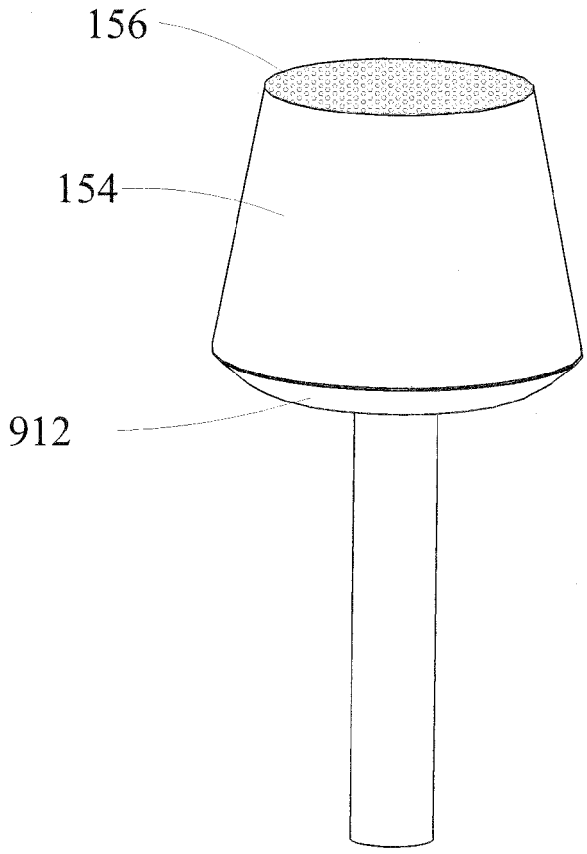
FIG. 13 is a perspective view of a portion of the hookah of the present invention.

As shown in FIG. 12, the system of the present invention could further include a bowl cover 154 version of the wind cover. The bowl cover 154 is a hollow device similar to a cup. The bowl cover 154 is sized to accept the hookah bowl 910 within its recess and rest upon the hookah coal tray 912. As FIG. 13 shows, when the bowl cover 154 contacts the coal tray 912, the hookah bowl (not shown) is protected within. Apertures 156 on the surface, preferably at the apex, of the bowl cover 154 allow oxygen access to the combustion materials of the hookah system. Alternative embodiments of the present invention feature a coal tray adapted to mate with the bowl cover. In such embodiments the bowl cover will removably affix, rather than rest, upon the coal tray. Means for temporarily affixing the bowl cover to the coal tray include mating magnetic connections on the bowl cover and the coal tray; mating snaps on the bowl cover and coal tray; mating peripheries on the bowl cover and coal tray; and a weighting lower portion of the bowl cover.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A portable hookah system comprising:

a hookah comprising: a hookah base for accepting dry smoke; a hookah stem, connected in self-supporting, releasable attachment to said hookah base, defining a wet smoke outlet and a bowl connection with a bowl connected thereto; and a hookah hose, configured to releasably attach to said smoke outlet, for conducting wet smoke to a user; and a hookah containment device comprising:

a receiving chamber with a chamber base and a chamber sidewall, said receiving chamber adapted to accept and vertically stabilize said hookah, said sidewall having a height adapted to house at least said hookah base and a circumference dimensioned to form an interference fit with said hookah base; said receiving chamber further comprising a cover, opposite said chamber base dimensioned to enclose said receiving chamber, defining an interior hookah stem outlet that positions said bowl above said receiving chamber; and a handle, attached to said hookah receiving chamber, configured to facilitate a substantially planar travel path.

2. The system of claim 1 wherein said handle is dimensioned to substantially clear said hookah stem of said hookah and includes a handle barrier.

3. The system of claim 1 wherein said sidewall comprises a height adapted to house said base and said wet smoke outlet, and said receiving chamber further defines a hose outlet.

4. The system of claim 3 wherein said sidewall defines said hose outlet.

5. The system of claim 4 wherein said hookah further comprises a coal tray removably affixed to said hookah stem and a bowl cover adapted to mate with said coal tray.

6. The system of claim 1 wherein said sidewall comprises a height adapted to house said hookah.

7. The system of claim 1 wherein said sidewall is a vertically-bifurcated, actuating sidewall.

8. A portable hookah system comprising:

a hookah comprising: a hookah base for accepting dry smoke; a hookah stem, connected in self-supporting, releasable attachment to said hookah base, defining a wet smoke outlet and a bowl connection with a bowl connected thereto; and a hookah hose, configured to releasably attach to said smoke outlet, for conducting wet smoke to a user; and a hookah containment device comprising:

a receiving chamber with a chamber base and a vertically-bifurcated, actuating chamber sidewall, said chamber base having attachment means to accept and vertically stabilize said hookah, with said sidewall having a height adapted to house said hookah base, and a cover defining an interior hookah stem outlet that positions said bowl above said receiving chamber; and a handle, attached to said hookah receiving chamber, configured to facilitate a substantially planar travel path.

9. The portable hookah system of claim 8 wherein said attachment means includes said hookah base and said chamber base having a mating groove-and-protrusion assembly.

10. The portable hookah system of claim 8 wherein said attachment means includes said hookah base and said chamber base having a mating fastener assembly.

* * * * *